US005108303A

United States Patent [19]

Maeda et al.

[11] Patent Number: 5,108,303

[45] Date of Patent: Apr. 28, 1992

[54] PACKING SUPPORT ARRANGEMENT FOR WATERPROOF CONNECTOR

[75] Inventors: Akira Maeda; Tetsuo Kato, both of Shizuoka, Japan

[73] Assignee: Yazaki Corporation, Tokyo, Japan

[21] Appl. No.: 676,594

[22] Filed: Mar. 28, 1991

[30] Foreign Application Priority Data

Apr. 10, 1990 [JP] Japan ..... 2-37671[U]

[51] Int. Cl.[5] ..... H01R 13/00

[52] U.S. Cl. ..... 439/271

[58] Field of Search ..... 439/271-282

[56] References Cited

U.S. PATENT DOCUMENTS 4,529,257 7/1985 Goodman et al. ..... 439/271

4,874,325 10/1989 Bensing et al. ..... 439/272

4,917,620 4/1990 Samejima et al. ..... 439/271

FOREIGN PATENT DOCUMENTS 61-60478 4/1986 Japan .

*Primary Examiner*—Joseph H. McGlynn

*Attorney, Agent, or Firm*—Sughrue, Mion, Zinn, Macpeak & Seas

[57] ABSTRACT

In a packing support arrangement for a waterproof connector in which a annular packing is fitted on an outer peripheral surface of a connector housing, the improvement comprising, support portions formed on the outer peripheral surface of the connector housing for supporting a front end portion of the annular packing, engaging recesses formed on an inner peripheral surface of the annular packing for receiving the support portions, and a reinforcement receptive portion formed at the front end portion of the annular packing and reinforced by the support portions. Accordingly, a smooth fitting relative to a mating connector housing can be maintained, and also deformation of the packing is prevented, thereby attaining a stable sealing purpose.

9 Claims, 5 Drawing Sheets

PACKING SUPPORT ARRANGEMENT FOR WATERPROOF CONNECTOR

BACKGROUND OF THE INVENTION

This invention relates to a waterproof connector used mainly for connecting automotive harnesses, and more particularly to a waterproof packing support arrangement.

In FIG. 18, reference numeral a denotes a male connector housing, and reference numeral b denotes a female connector housing. A waterproof cover portion al is formed at the outer portion of the male connector housing. Reference numerals c and d denote a female terminal and a male terminal, respectively.

An annular waterproof packing e is mounted on the outer peripheral portion of the male connector housing a, and is fixed thereto by fitting a recess el on a projection a2.

In the above construction, as shown in FIG. 19, if the male and female connector housings a and b are butted together in an inclined manner when they are to be fittingly engaged with each other, an end b1 of the female connector housing b pinches the end of the waterproof packing to deform it, thereby making the seal incomplete. Furthermore, there is a possibility that the two connector housings can not be fittingly connected together.

SUMMARY OF THE INVENTION

The present invention has been made in view of the above problems, and an object of the invention is to prevent deformation of a waterproof packing even if a localized force is applied to the packing when fitting a male connector in a female connector.

In order to attain the above-noted and other objects, the present invention provides a packing support arrangement for a waterproof connector in which an annular packing is fitted on an outer peripheral portion of a connector housing, the arrangement comprising: support means formed on the outer peripheral portion of the connector housing for supporting a front end portion of the annular packing; engaging recess means formed in an inner peripheral portion of the annular packing for receiving the support means; and a reinforcement receptive portion formed at the front end portion of the annular packing and reinforced by the support portion.

In the present invention, as the support means, a plurality of Rib-like support portions may be formed, each extending from a rear end of the connector housing to a vicinity of a front end thereof, and, as the engaging recess means, a plurality of groove-like engaging recesses, which corresponds respectively to said Rib-like support portions, may be formed.

Similarly, an annular support portion for defining a step portion on a front end portion of the connector housing may be formed, whereas an annular engaging recess fitted with said annular engaging support portion may be formed.

An annular projection projecting from a front end of said connector housing may be formed whereas a flange directed inwardly from a front end portion of the packing and formed with an annular groove for receiving the projection may be formed.

In addition, the arrangement may be further provided with a cover cylinder provided around the connector housing for defining a space for a mating connector housing, retaining pawls formed on an rear end portion of the packing and extending therefrom, and retaining holes formed in the cover cylinder and respectively engaged with said retaining pawls for retaining the packing on the outer peripheral portion of the connector housing.

The above-noted and other objects can also be attained by a packing support arrangement for a waterproof connector in which an annular packing is fitted on an outer peripheral portion of a connector housing, the arrangement comprising: a support ring made of a rigid material and integrally connected to the annular packing; and a reinforcement receptive portion reinforced by the support ring and formed on a front end of the annular packing.

The arrangement may be further provided with at least one retaining recess formed in the support ring, and at least one retaining projection formed on the outer peripheral portion of the connector housing, and respectively engaged with the at least one retaining projection for retaining the packing on the outer peripheral portion of the connector housing.

DETAILED DESCRIPTION OF THE PREFERRED EMBODIMENTS

FIGS. 1 to 5 show a packing support arrangement according to a first embodiment of the present invention.

Figure 1:
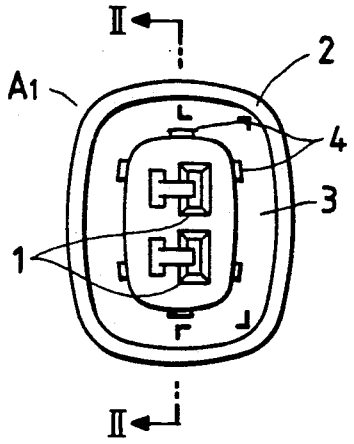
FIG. 1 is a front-elevational view of a connector housing, showing a first embodiment of the invention.
Figure 2:
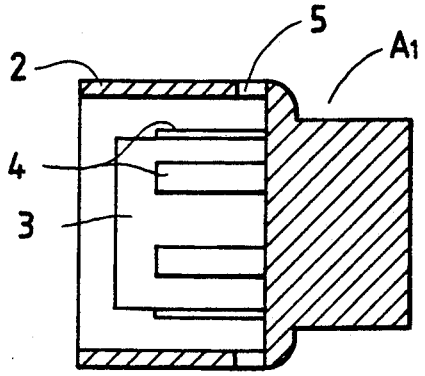
FIG. 2 is a cross-sectional view taken along the line II—II of FIG. 1.
Figure 3:
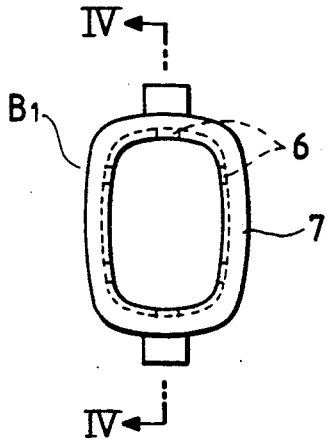
FIG. 3 is a front-elevational view of a waterproof packing used in the first embodiment.
Figure 4:
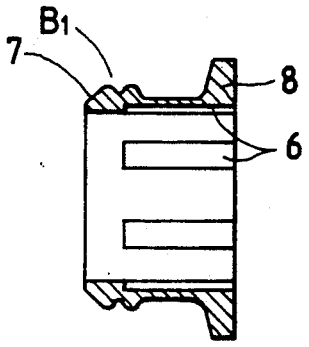
FIG. 4 is a cross-sectional view taken along the line IV—IV of FIG. 3.

FIGS. 1 and 2 show a male connector housing Al made of a synthetic resin. Metal terminals (not shown) are inserted respectively into terminal receiving chambers 1 within this male connector housing Al, and are retained there. The male connector housing Al has at its outer portion a cover portion forming a receiving space for receiving a mating female connector housing therein. Rib-like support portions 4 are formed on an outer peripheral surface 3, and are spaced from one another at suitable intervals in the direction of the periphery, the support portions 4 extending in the axial direction. Retaining holes 5 for a waterproof packing B1 shown in FIGS. 3 and 4 are formed in the cover portion 2.

The waterproof packing B1 is made of rubber and formed at its inner peripheral surface with a plurality of groove-like engaging recesses 6 which correspond respectively to the rib-like support portions 4 so as to receive them therein. At the front end of the packing B1, provided is a reinforcement receptive portion 7. Therefore, the groove-like engaging recesses 6 terminate at the vicinity of the reinforcement receptive portion 7. Retaining pawls 8 are formed on the rear end portion of the packing B1.

Figure 5:
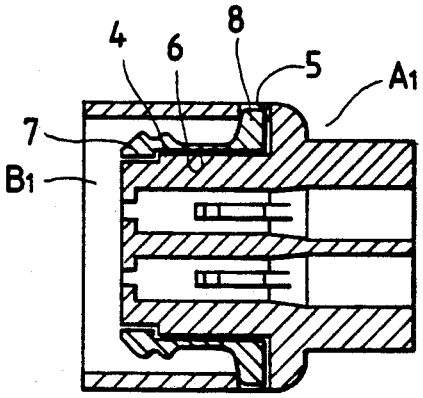
FIG. 5 is a cross-sectional view showing a connected condition of the above arrangement.
Figure 6:
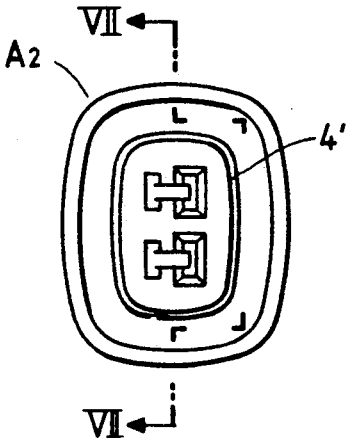
FIG. 6 is a front-elevational view of a connector housing, showing a second embodiment of the invention.
Figure 7:
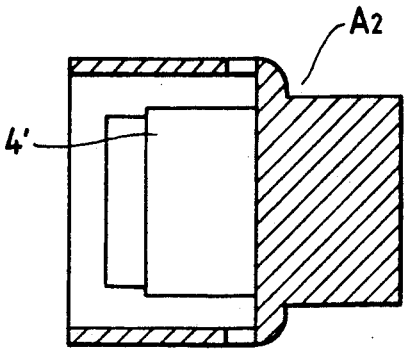
FIG. 7 is a cross-sectional view taken along the line VII—VII of FIG. 6.
Figure 8:
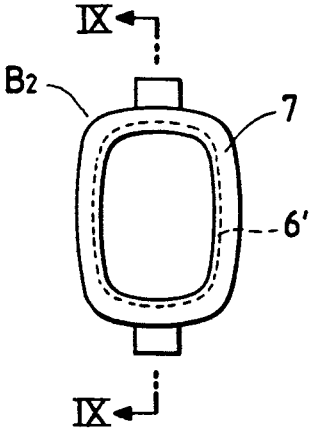
FIG. 8 is a front-elevational view of a waterproof packing used in the second embodiment.
Figure 9:
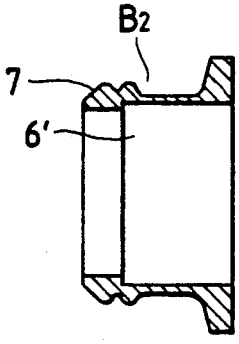
FIG. 9 is a cross-sectional view taken along the line IX—IX of FIG. 8.
Figure 10:
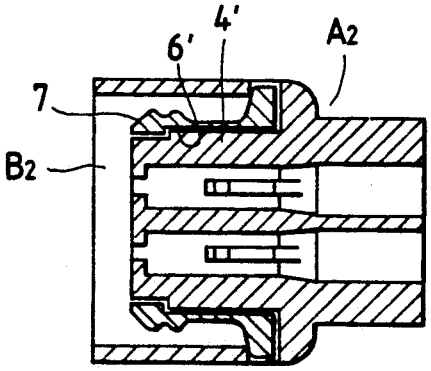
FIG. 10 is a cross-sectional view showing a connected condition of the above arrangement.

In the above construction, when the waterproof packing B1 is fitted on the outer peripheral surface 3 of the male connector housing Al, the retaining pawls 8 are engaged respectively in the retaining holes 5, and the groove-like engaging recesses 6 are engaged respectively with the rib-like support portions 4 as shown in FIG. 5.

In use, even if the front end of the mating female connector housing (not shown) impinges upon the front end of the waterproof packing B1, i.e. the reinforcement receptive portion 7 of the waterproof packing B1, the reinforcement receptive portion 7 is prevented from being displaced and deformed since the reinforcement receptive portion 7 is supported by the rib-like support portions 4. Therefore, a sealing performance will not be lowered.

FIGS. 6 to 10 show a packing support arrangement according to a second embodiment of the present invention.

The packing support arrangement shown in FIGS. 6 to 10 differs from the arrangement of the first embodiment in that instead of the above rib-like support portions 4, an annular support portion 4' is formed on a male connector housing A2 and that an annular engaging recess 6' is formed in a waterproof packing B2. The annular support portion 4' is fitted in the annular engaging recess 6', and a reinforcement receptive portion 7 is formed at the front end of the waterproof packing B2.

Figure 11:
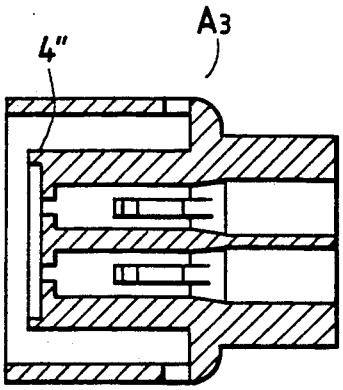
FIG. 11 is a cross-sectional view of a connector housing, showing a third embodiment of the invention.
Figure 12:
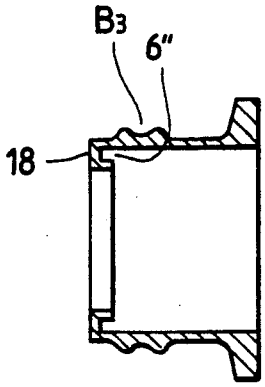
FIG. 12 is a cross-sectional view of a waterproof packing used in the third embodiment.
Figure 13:
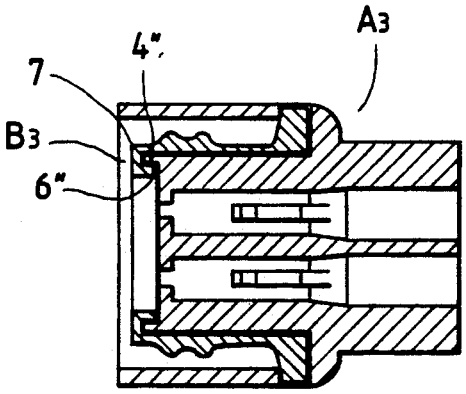
FIG. 13 is a cross-sectional view showing a connected condition of the above arrangement.

FIGS. 11 to 13 show a packing support arrangement according to a third embodiment of the present invention.

In the arrangement shown in FIGS. 11 to 13, an annular support portion 4'' is formed on an outer peripheral portion of a front end of a male connector housing A3, and an inwardly-directed flange 18 is formed integrally on an inner surface of a front end of a waterproof packing B3 to form an annular engaging recess 6''. The annular support portion 4'' is fitted in the annular engaging recess 6'', and a reinforcement receptive portion 7 is formed at the front end of the waterproof packing B3.

Figure 14:
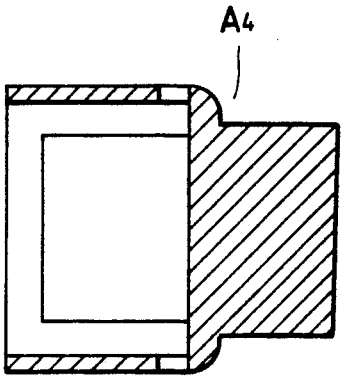
FIG. 14 is a cross-sectional view of a connector housing, showing a fourth embodiment of the invention.
Figure 15:
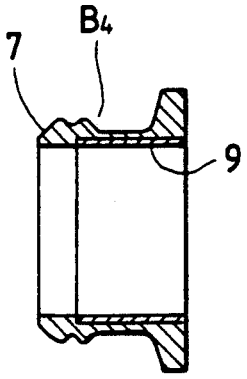
FIG. 15 is a cross-sectional view of a waterproof packing used in the fourth embodiment.
Figure 16:
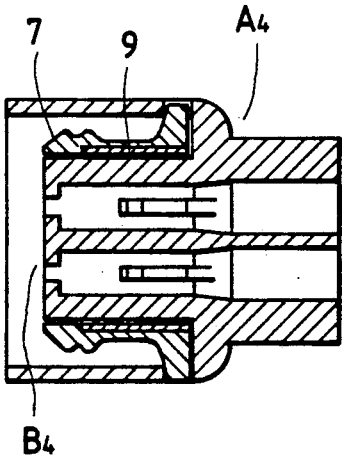
FIG. 16 is a cross-sectional view showing a connected condition of the above arrangement.

FIGS. 14 to 16 show a packing support arrangement according to a fourth embodiment of the present invention.

In the arrangement shown in FIGS. 14 to 16, a waterproof packing B4 is integrally molded, with a support ring 9 of metal or a synthetic resin integrally connected to the inner peripheral portion of the waterproof packing B4. The waterproof packing B4 forms a reinforcement receptive portion 7 at its front end by itself. Therefore, a male connector housing A4 on which the waterproof packing B4 is fitted does not particularly have a support means for the reinforcement support portion 7.

Figure 17:
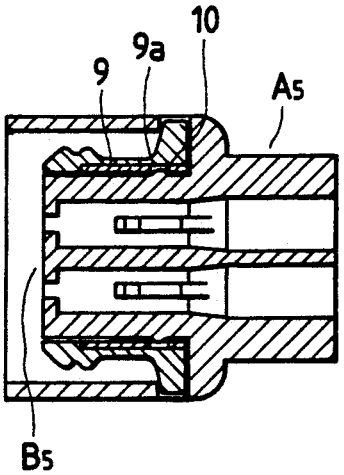
FIG. 17 is a cross-sectional view showing the condition of connection between a connector housing and a waterproof packing, showing a fifth embodiment of the invention.
Figure 18:
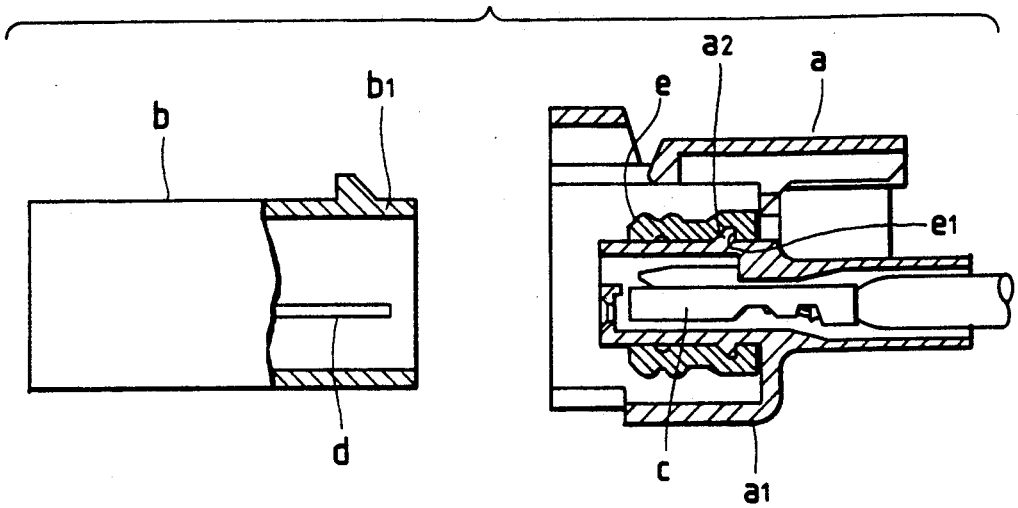
FIG. 18 is a cross-sectional view showing conventional male and female connector housings separated from each other.
Figure 19:
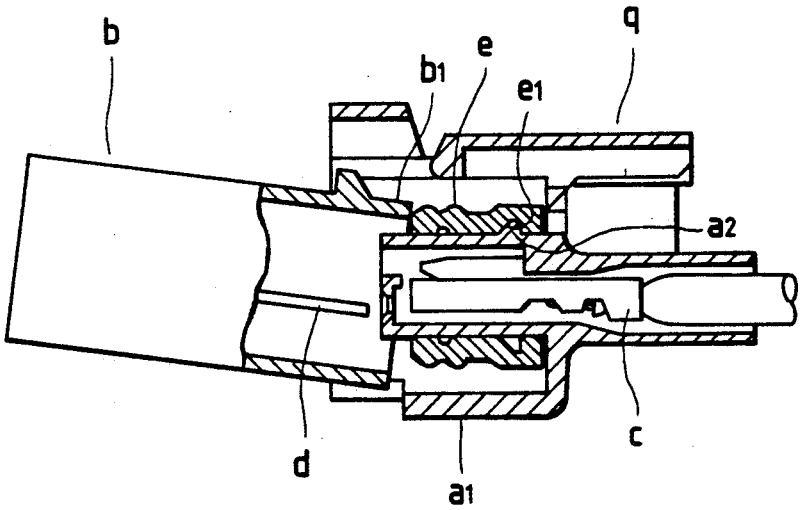
FIG. 19 is a cross-sectional view showing the manner of fitting the conventional male connector housing into the conventional female connector housing.

In a packing support arrangement shown in FIG. 17, in addition to the arrangement of the preceding embodiment, retaining projections 10 are formed on an outer peripheral portion of a connector housing A5, and are engaged respectively with retaining recesses 9*a* formed in a support ring 9 of a waterproof packing B5.

With the above arrangements of the present invention, the reinforcement receptive portion is provided at the front end of the waterproof packing in cooperation with the support portion. Therefore, a smooth fitting relative to the mating connector housing can be maintained, and also deformation of the packing is prevented, thereby maintaining a stable sealing performance.

What is claimed is:

1. A packing support arrangement for a waterproof connector in which an annular packing is fitted on an outer peripheral portion of a connector housing, said arrangement comprising:

support means formed on said outer peripheral portion of said connector housing for supporting a front end portion of said annular packing;

engaging recess means formed in an inner peripheral portion of said annular packing for receiving said support means; and a reinforcement receptive portion formed at the front end portion of said annular packing and reinforced by said support portion.

2. The arrangement according to claim 1, wherein said support means includes a plurality of rib-like support portions, each extending from a rear end of said connector housing to a vicinity of a front end thereof, and said engaging recess means includes a plurality of groove-like engaging recesses corresponding respectively to said rib-like support portions.

3. The arrangement according to claim 1, wherein said support means includes an annular support portion for defining a step portion on a front end portion of said connector housing, and said engaging recess means includes an annular engaging recess fitted with said annular support portion.

4. The arrangement according to claim 1, wherein said support means includes an annular projection projecting from a front end of said connector housing, and said engaging recess includes a flange directed inwardly from a front end portion of said packing and formed with an annular groove for receiving said projection.

5. The arrangement according to claim 1, further comprising:

a cover cylinder provided around said connector housing for defining a space for a mating connector housing;

retaining pawls formed on an rear end portion of said packing and extending therefrom; and retaining holes formed in said cover cylinder and respectively engaged with said retaining pawls for retaining said packing on said outer peripheral portion of said connector housing.

6. A packing support arrangement for a waterproof connector in which an annular packing is fitted on an outer peripheral portion of a connector housing, said arrangement comprising:

a reinforcement receptive portion formed on a front end of said annular packing; and support means integrally connected to said annular packing for supporting said reinforcement receptive portion, said support means including a support ring made of a rigid material.

7. The arrangement according to claim 6, further comprising:

at least one retaining recess formed in said support ring; and at least one retaining projection formed on said outer peripheral portion of said connector housing, and respectively engaged with said at least one retaining recess for retaining said packing on said outer peripheral portion of said connector housing.

8. The arrangement according to claim 6 wherein said support ring is tubular in shape and is disposed along an inner circumferential portion of said annular packing.

9. A packing support arrangement for a waterproof connector in which an annular packing is fitted on an outer peripheral portion of a connector housing, said arrangement comprising:

a support ring made of a rigid material and integrally connected to said annular packing;

a reinforcement receptive portion reinforced by said support ring and formed on a front end of said annular packing;

at least one cylinder provided around said connector housing for defining a space for a mating connector housing;

retaining pawls formed on a rear end portion of said packing and extending therefrom; and retaining holes formed in said cover cylinder and respectively engaged with said retaining pawls for retaining said packing on said outer peripheral portion of said connector housing.

* * * * *